US005271515A

United States Patent [19]

Berkheimer et al.

[11] Patent Number: 5,271,515

[45] Date of Patent: Dec. 21, 1993

[54] MULTI-TIERED DISPLAY

[75] Inventors: Steven E. Berkheimer, Chicago; Jim Durish, South Holland; Edward J. Keogh, Crystal Lake; Alfred Landa, Westmont, all of Ill.

[73] Assignee: Wm. Wrigley Jr. Company, Chicago, Ill.

[21] Appl. No.: 905,348

[22] Filed: Jun. 29, 1992

[51] Int. Cl.[5] ..... B65D 6/00

[52] U.S. Cl. ..... 220/4.27; 220/23.83; 206/503; 312/107

[58] Field of Search ..... 220/4.27, 23.4, 23.6, 220/23.83; 206/509, 511, 512, 503; 312/107

[56] References Cited

U.S. PATENT DOCUMENTS

| | | | |
|---|---|---|---|
| 3,219,400 | 11/1965 | Bergquist | 206/511 X |
| 3,999,818 | 12/1976 | Schankler | 312/107 X |
| 5,111,939 | 5/1992 | Schafer | 206/503 |

*Primary Examiner*—Allan N. Shoap
*Assistant Examiner*—Paul A. Schwarz

[57] ABSTRACT

A multi-tiered display for holding and displaying a plurality of items. The display comprises at least two stackable interlocking canisters. Each canister has a substantially similar construction and comprises a bottom surface and a top surface. The bottom surface includes in a preferred embodiment, a first, second, and third projecting member each of which extends along a width of the bottom surface. The top surface includes a fourth, fifth, and sixth projecting member that extends along a width of the top surface. The bottom surface further includes a first, second, and third space for receiving the fourth, fifth, and sixth projecting members. The top surface includes a fourth and fifth space for receiving the second and third projecting members. Due to the structure of the canisters, the canisters when stacked are interlocked at three locations.

18 Claims, 1 Drawing Sheet

MULTI-TIERED DISPLAY

BACKGROUND OF THE INVENTION

The present invention relates generally to displays for housing articles. More specifically, the present invention relates to vertically stackable multi-tiered displays for housing and displaying articles for purchase.

It is of course known for merchants and others to display articles in containers that allow the prospective purchaser to view and access the article. A number and variety of such displays are known. Typically, the containers will have a body defining an interior for housing the articles and an opening providing access to the interior and thereby the housed article.

Due to space constraints and other concerns, it is also known to provide multi-tiered displays. The advantage of a multi-tiered display is that it provides a number of separate containers that can be used to house different articles. Additionally, a multi-tiered structure allows the display to be oriented in a vertical direction. This can be especially important in those situations where space is at a premium.

Multi-tiered displays can be used for a variety of consumer articles and products. By way of example only, one area in which multi-tiered displays are used is for gum, candy, and like products. An example of such a multi-tiered display that has been used, is a multi-tiered display distributed by the Wm. Wrigley Jr. Company, Chicago, Illinois. This multi-tiered display includes a plurality of stackable canisters having substantially similar construction. The canisters are constructed from a translucent plastic allowing the articles housed therein to be viewed through the canisters.

Each canister of the display includes a front face having an opening therein. The bottom and top surfaces of each canister are constructed so as to allow the canisters to be stacked, creating a multi-tiered vertical structure. To this end, the top surface of each canister includes a single projecting member. The projecting member has a substantially rectangular cross-sectional shape, although it is slightly tapered toward a bottom surface thereof. The bottom surface of each canister includes a single slot defining a space having a cross-sectional shape that is substantially similar to the cross-sectional shape of the projecting member located on the top surface. The projecting member is snapped into, or slid into, the slot allowing the canisters to be stacked creating a multi-tiered vertical structure.

Although usable multi-tiered vertical displays are known, there may be, in certain instances, disadvantages with known structures. For example, it is desirable that the individual canisters house as much product as possible. However, due to the structure of some known multi-tiered displays, it is not possible to merely increase the interior space of the canister because if too much product is housed in the lower canisters, the canisters will separate when one tries to move the display by grasping only the top canister.

There is therefore a need for an improved multi-tiered display.

SUMMARY OF THE INVENTION

The present invention provides an improved multi-tiered display for holding and displaying a plurality of items. The multi-tiered display is constructed so as to allow the individual canisters to house increased amounts of product and still allow the display to be moved by grasping the top canister of the display. Due to the interlocking nature of the canisters, it is believed a display that is at least three canisters tall will not separate when so moved even though filled with at least certain products.

To this end, in an embodiment, the present invention provides a multi-tiered display for holding and displaying a plurality of items. The display comprises at least two stackable interlocking canisters. Each canister has a substantially similar construction and comprises a bottom surface and a top surface. The bottom surface includes at least two projecting members extending along a width of the bottom surface. The top surface includes at least three projecting members extending along a width of the top surface. The bottom surface further includes three spaces for receiving the three projecting members of the top surface of another canister. The top surface includes two spaces for receiving the two projecting members of a bottom surface of another canister. Preferably, each canister includes a front surface that includes an inclined face having an opening therein for accessing an interior of the canister.

Preferably, the bottom surface includes a third projecting member that defines with the first projecting member the first space.

In an embodiment, each of the third, fourth, and fifth projecting members has a different cross-sectional shape than the other projecting members.

In an embodiment, the first and second projecting members have substantially the same cross-sectional shape.

In an embodiment, the front surface includes a first surface that extends at an obtuse angle from the bottom surface to the front face.

The present invention also provides a stackable canister for storing and displaying articles. The canister is stackable, and interlockable, with similar canisters. In an embodiment, the canister comprises a bottom surface and a top surface. The bottom surface includes at least two projecting members that extend along a width of the bottom surface. The top surface includes at least three projecting members that extend along a width of the top surface. The bottom surface further includes three spaces for receiving the three projecting members of the top surface of another canister. The top surface includes at least two spaces for receiving the two projecting members of a bottom surface of another canister.

Preferably, the bottom surface of the canister also includes a third projecting member located near a front of the canister.

An advantage of the present invention is that it provides a stable multi-tiered display for housing and displaying articles.

A further advantage of the present invention is that it provides a more aesthetically pleasing multi-tiered display.

Furthermore, an advantage of the present invention is that it provides a structure wherein canisters are interlocked at three locations to each other, i.e., the front, middle, and back.

Moreover, an advantage of the present invention is that it provides a multi-tiered display that can house an increased volume of product.

Additionally, an advantage of the present invention is that it provides a multi-tiered structure having an improved locking structure allowing at least a three canister display to be filled with at least certain products and lifted by the top canister without the bottom units separating.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides an improved multi-tiered display. The multi-tiered display provides means for containing and displaying products for prospective purchasers.

Figure 1:
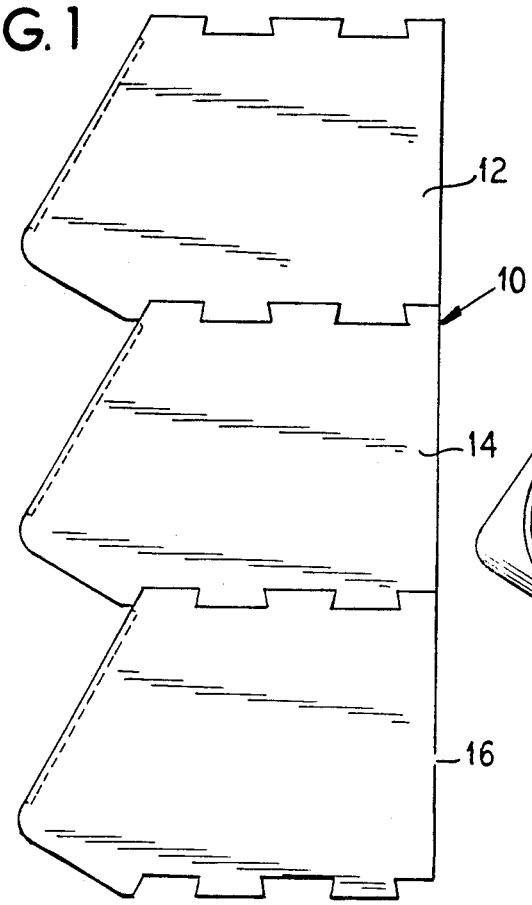
FIG. 1 illustrates a perspective view of an embodiment of the multi-tiered display of the present invention.

Referring now to FIG. 1, the multi-tiered display 10 is generally illustrated. In the illustrated embodiment, the multi-tiered display 10 comprises three separate canisters 12, 14, and 16, respectively. Although in the illustrated embodiment, the multi-tiered display 10 comprises three stacked canisters 12, 14, and 16, it should be appreciated that in use the multi-tiered display 10 can comprise more than three stacked canisters or less than three. In the preferred embodiment illustrated, each of these canisters 12, 14, and 16 has a substantially similar construction that will be discussed in detail below.

In use, each of the canisters 12, 14, and 16 will house articles to be displayed to the consumer. Due to its vertical structure, the multi-tiered display 10 can be advantageously used in areas where space is at a premium.

As illustrated, the multi-tiered display 10 provides an aesthetically pleasing structure. Further, as can be appreciated from FIG. 1, due to the interlocking nature of each of the canisters 12, 14, and 16 in the resultant multi-tiered display 10, a stable structure is provided. Indeed, it is believed that the illustrated three canister 12, 14, and 16 multi-tiered display 10 can be filled with at least certain product, such as gum, and lifted by the top canister 12, without the canisters 14 and 16 separating.

Figure 2:
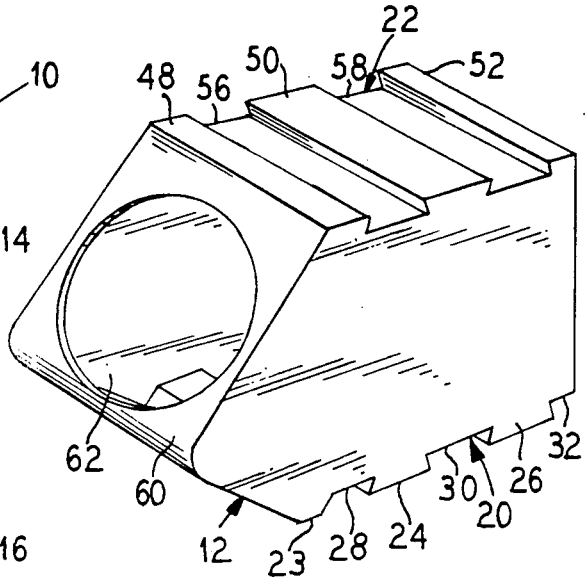
FIG. 2 illustrates a front elevational view of a single canister from the multi-tiered display.
Figure 3:
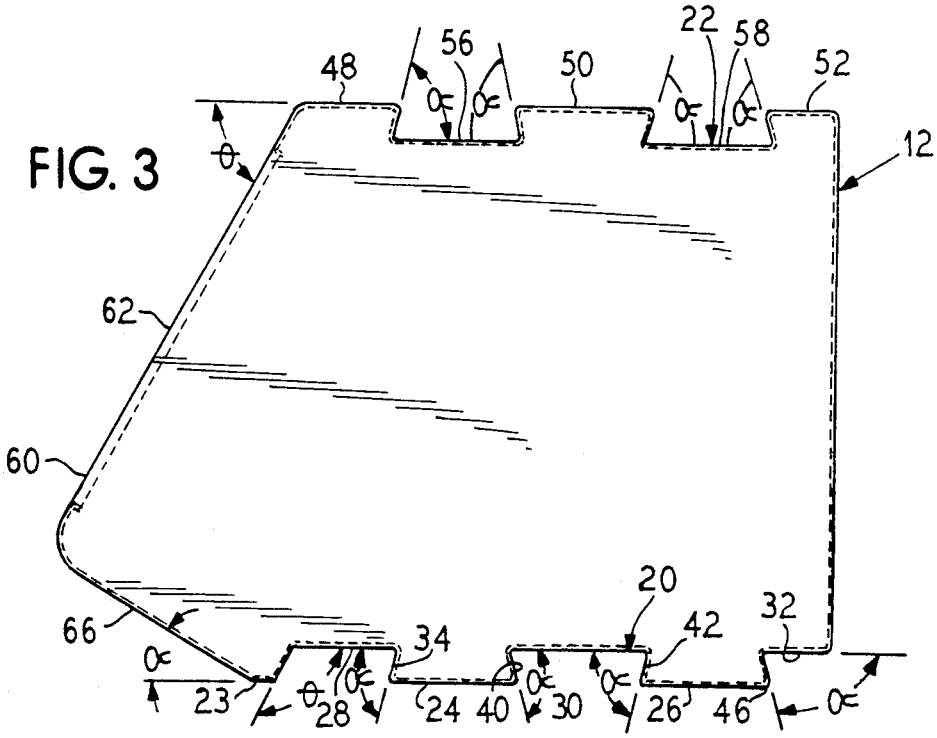
FIG. 3 illustrates a side elevational view of the canister of FIG. 2.

Referring now to FIGS. 2 and 3, an individual canister 12 is illustrated. For the sake of brevity, only canister 12 will be referred to, however, as previously stated, each of the canisters 12, 14, and 16 preferably has substantially the same shape and construction.

The canister 12 is preferably constructed from a plastic material. For example, the canister 12 can be constructed from polyvinyl chloride, however, other plastic materials can be used. The canister 12 can be constructed through a variety of methods such as blow molding, injection molding, or other thermoforming methods.

Preferably, the canister 12 is translucent. This allows the consumer to view product housed within the canister 12 through the canister. If desired, the canister 12 can contain indicia, that is, for example, stamped into a side of the canister 12. Of course, the indicia can comprise a sticker or other material secured to the canister 12. This indicia can be, for example, a brand name, company name, or the like.

Each canister 12 includes a bottom surface 20 and a top surface 22. These surfaces 20 and 22, as set forth in detail hereinafter, are constructed so as to provide interlocking stackable canisters 12, allowing the canisters to create the multi-tiered display 10.

In the preferred embodiment illustrated, the bottom surface 20 includes three projecting members 23, 24, and 26. If desired, only two projecting members 24 and 26 can be utilized. Likewise, additional projecting members could be used if desired.

In the preferred embodiment illustrated, projecting members 24 and 26 have substantially the same cross-sectional shape. The projecting members 23, 24, and 26 extend across a width of the bottom surface 20. Projecting members 24 and 26 preferably define in cross-sectional shape truncated triangular bases, i.e., are dove tail-shaped. As will be appreciated, this shape provides an interlocking feature when the canisters 12, 14, and 16 are stacked.

Additionally, the bottom surface 20 includes, in the preferred embodiment illustrated, first, second, and third spaces 28, 30, and 32. Again, depending on the structure of the top surface 22 less than or more than three spaces may be used. The first space 28, or slot, is defined by the first projecting member 23 and a leading edge 34 of the second projecting member 24. The second space 38, or slot, is defined by the trailing edge 40 of the second projecting member 24 and the leading edge 42 of the third projecting member 26. Additionally, the third space, or cut-out portion, 32 is provided at a trailing edge 46 of the third projecting member 26.

Correspondingly, in the preferred embodiment illustrated, the top surface 22 includes three projecting members 48, 50, and 52. Similar to the projecting members 23, 24, and 26 of the bottom surface 20, the first, second, and third projecting members 48, 50, and 52 at the top surface extend for the width of the canister 12. Again, if desired, more than or less than three projecting members can be used.

The first, second, and third projecting members 48, 50, and 52 are constructed so as to provide interlocking characteristics with the bottom surface 20 of a corresponding canister. To this end, the first projecting member 48 of the top surface 22 has a cross-sectional shape that is substantially similar to that of the first slot 28 on the bottom surface 20. Likewise, the second projecting member 50 has a cross-sectional shape that is substantially similar to that of the second slot 30 on the bottom surface 20. This shape preferably is that of a truncated triangle. Further, the third projecting member 52 has a cross-sectional shape that is substantially similar to the cut-out portion 32 of the bottom surface 20. Therefore, the first, second, and third projecting members 48, 50, and 52 can interlock with the first, second, and third spaces 28, 30, and 32 at the bottom surface 20.

To achieve this mating, the first, second, and third projecting surfaces 48, 50, and 52 of a canister are slid into the respective spaces 28, 30, and 32 on the bottom surface 20 of another canister. Due to the slot-like nature of the second space 30 and the truncated triangular shape of the second projecting member 50, an interlocking fit is created.

Additionally, in the preferred embodiment illustrated, the top surface 22 includes a first and second slot 56 and 58, respectively. The first and second slots 56 and 58 have a substantially similar cross-sectional shape to that of the second and third projecting members 24 and 26 of the bottom surface 20. When the first and second projecting members are slid into the first and second slots 56 and 58 of the top surface 22, an interlocking fit is created. Thus, a stackable, stable multi-tiered display 10 is created.

The interlocking fit created by the structure of the canisters 12, 14, and 16 is sufficiently strong to allow in a three canister display 10, such as that illustrated in FIG. 1, the display 10 to be moved by grasping canister 12 and lifting same. It is believed that the interlocking fit prevents the canisters 12, 14, and 16 from separating even when the canisters are filled with, for example, gum. In fact, the interlocking feature allows the canisters 12, 14, and 16 to contain more articles than typical previous canisters and still not separate when moved by grasping only the top canister 12. At least in part, the strength of the interlocking fit is due to the fact that the canisters, for example 12 and 14, are interlocked together at three separate locations.

As illustrated, each canister 12 includes an inclined front face 60 having an opening 62. Preferably, the opening 62 is substantially circular, however, oval openings and other shapes can be utilized. Depending on the articles to be displayed, the size and shape of the opening 62 can be modified.

Preferably, the front 64 of the canister 12 also includes a portion 66 that extends from the first projecting member 23 of the bottom surface 20 at an angle $\delta$ to the front face 60. Such a structure provides an increased area for containing product at the opening 62 of the canister 12.

In a preferred embodiment, that has been found to function satisfactorily, a stable stackable display 10 is created when angles $\alpha$ are preferably each approximately 80°, angles $\Theta$ are preferably approximately 60°, and angle $\delta$ is preferably approximately 30°.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

We claim:

1. A multi-tiered display for holding and displaying a plurality of items comprising:

at least a first and a second substantially identical canister;

each canister defining a body having a n interior for containing an item, and a first and a second surface, the first surface and second surface of the first and second canister being designed to mate in an interlocking manner allowing the first and second canisters to be stacked, the first surface including at least first and second projecting members and defining at least first and second spaces for receiving projections, the second surface including at least third and fourth projecting members and defining at least third and fourth spaces for receiving projections, each of the third and fourth spaces defining a space having a cross-sectional shape that is substantially similar to a cross-sectional shape of either the first or second projecting member and being so constructed and arranged to receive one of the first and second projecting members therein, and each of the first and second spaces having a cross-sectional shape substantially similar to one of the third or fourth projecting members and being so constructed and arranged to receive one of the third or fourth projecting members therein, wherein each canister includes an inclined front face having an opening allowing access to the interior of the canister.

2. A multi-tiered display of claim 1 wherein the third and fourth projecting members have different cross-sectional shapes and correspondingly the first and second spaces for receiving projections have a different cross-sectional shape.

3. The multi-tiered display of claim 1 wherein the front face extends, at an acute angle, from a plane defined by a surface upon which the canister is placed.

4. The multi-tiered display of claim 1 wherein each canister is constructed from a substantially translucent material.

5. The multi-tiered display of claim 1 wherein at least the second surface includes a third projecting member.

6. The multi-tiered display of claim 1 wherein the first and second projecting members have substantially the same cross-sectional shape.

7. The multi-tiered display of claim 6 wherein the first and second projecting members have a truncated triangle cross-sectional shape.

8. A multi-tiered display for holding and displaying a plurality of items comprising:

at least two stackable interlocking canisters;

each canister having a substantially similar construction and comprising a bottom surface of a first length and a top surface of a second length wherein the first length is greater than the second length, the bottom surface including at least a first, a second, and a third projecting member, each of which extends along a width of the bottom surface and the top surface including at least a fourth, fifth, and sixth projecting member, each of which extends along a width of the top surface, the bottom surface further including a first, second, and third space for receiving respectively the fourth, fifth, and sixth projecting members of the other canister, and the top surface including a fourth and fifth space for receiving respectively the second and third projecting members of the other canister, each canister including an opening for accessing an interior of the canister.

9. The multi-tiered display of claim 8 wherein each of the fourth, fifth, and sixth projecting members have a different cross-sectional shape than the other.

10. The multi-tiered display of claim 8 wherein the second and third projecting members have substantially the same cross-sectional shape.

11. The multi-tiered display of claim 8 wherein when two canisters are secured together they are interlocked at three separate locations.

12. The multi-tiered display of claim 8 the opening is located on an inclined front face of the canister.

13. The multi-tiered display of claim 8 wherein each canister is constructed from a substantially translucent material.

14. A stackable canister for storing and displaying articles, the canister being stackable, and interlockable, with a similar canister and comprising:

a bottom surface and a top surface, the bottom surface including at least a first and a second projecting member each of which extends along a width of the bottom surface and the top surface including at least a third, fourth, and firth projecting member each of which extends along a width of the top surface, the bottom surface further including a first, second and third space for receiving the respectively third, fourth, and fifth projecting members of the similar canister, and the top surface including a fourth and fifth space for receiving respectively the first and second projecting member of the similar canisters, each canister including a front surface that includes an opening therein for accessing an interior of the canister wherein a length of the bottom surface is greater than a length of the top surface.

15. The multi-tiered display of claim 14 wherein each of the third, fourth, and fifth projecting members have a different cross-sectional shape than the other.

16. The multi-tiered display of claim 14 wherein the bottom surface includes a third projecting member.

17. The multi-tiered display of claim 14 wherein the first and second projecting members have substantially the same cross-sectional shape.

18. The multi-tiered display of claim 17 wherein the first and second projecting members have a truncated triangle cross-sectional shape.

* * * * *